US006372993B1

(12) United States Patent
Eckels et al.

(10) Patent No.: US 6,372,993 B1
(45) Date of Patent: Apr. 16, 2002

(54) SEALED TERMINAL ASSEMBLY FOR HERMETIC COMPRESSOR

(75) Inventors: Richard Edgar Eckels, Spring Valley; Carl Herman Knapke, Maplewood, both of OH (US)

(73) Assignee: Copeland Corporation, Sidney, OH (US)

( * ) Notice: Subject to any disclaimer, the term of this patent is extended or adjusted under 35 U.S.C. 154(b) by 1010 days.

(21) Appl. No.: 08/968,845

(22) Filed: Nov. 5, 1997

Related U.S. Application Data

(63) Continuation of application No. 08/489,803, filed on Jun. 13, 1995, now abandoned.

(51) Int. Cl.[7] ..... H01B 17/30

(52) U.S. Cl. ..... 174/152 GM; 439/275; 439/282; 439/881; 439/935

(58) Field of Search ..... 174/152 GM; 439/275, 282, 502, 685, 881, 911, 926, 935

(56) References Cited

U.S. PATENT DOCUMENTS

| | | | | |
|---|---|---|---|---|
| 3,336,567 A | | 8/1967 | Coldren | 439/685 |
| 3,764,960 A | | 10/1973 | Heimbrock | 439/749 |
| 3,842,396 A | | 10/1974 | Olsson | 439/685 |
| 3,850,496 A | | 11/1974 | Hague | 439/685 |
| 3,917,377 A | | 11/1975 | Hall et al. | 439/749 |
| 4,252,394 A | | 2/1981 | Miller | 439/566 |
| 4,584,433 A | | 4/1986 | Bowsky et al. | 174/152 GM |
| 4,740,177 A | | 4/1988 | Heimbrock | 439/596 |
| 4,786,762 A | | 11/1988 | Bowsky et al. | 174/152 GM |
| 5,017,740 A | | 5/1991 | Honkomp et al. | 174/152 GM |
| 5,035,653 A | | 7/1991 | Honkomp et al. | 439/622 |
| 5,129,843 A | | 7/1992 | Bowsky et al. | 439/685 |
| 5,131,858 A | | 7/1992 | Heimbrock | 439/181 |
| 5,145,417 A | | 9/1992 | Honkomp et al. | 439/685 |
| 5,199,898 A | | 4/1993 | Wisner | 439/367 |
| 5,336,105 A | | 8/1994 | Wisner | 439/367 |
| 5,580,266 A | * | 12/1996 | Shelly | 439/281 |
| 5,584,716 A | * | 12/1996 | Bergman | 439/282 |

FOREIGN PATENT DOCUMENTS

| | | | | |
|---|---|---|---|---|
| FR | 1314138 | * | 11/1962 | 439/271 |

* cited by examiner

*Primary Examiner*—Albert W. Paladini
(74) *Attorney, Agent, or Firm*—Harness, Dickey & Pierce, P.L.C.

(57) ABSTRACT

A terminal assembly for a hermetic compressor having a shell includes a terminal block secured to the shell. A terminal fence surrounds the terminal block and is also fixedly secured to the shell. An intermediate gasket sealingly engages both the shell and the terminal block. A power plug is electrically connected to the terminal block and sealingly engaged by the intermediate gasket. A terminal block cover is secured to the shell in order to retain the connection between the various components. The terminal assembly once properly installed is capable of sealing the electrical connection for the compressor from direct contamination by high humidity and salt water spray normally experienced during trans-oceanic shipping.

18 Claims, 4 Drawing Sheets

SEALED TERMINAL ASSEMBLY FOR HERMETIC COMPRESSOR

This a continuation of U.S. patent application Ser. No. 08/489,803, filed Jun. 13, 1995.

FIELD OF THE INVENTION

The present invention relates to a sealed terminal assembly including the electrical cable for use with hermetic compressors. More particularly, the present invention relates to a sealed terminal assembly which effectively seals the connection between the electrical terminal and the cable from moisture and debris including the moisture which the terminal assembly experiences during trans-oceanic shipping.

BACKGROUND OF THE INVENTION

Prior art terminal assemblies have included both electrical terminals with covers and/or fences which are designed to protect the terminals from physical damage, electrically isolating the terminals for safety concerns and sealing the terminal assemblies from moisture and debris which the terminal assembly is exposed to during its normal operating life. While these prior art terminal assemblies have been effective, there is always a need to improve the sealing of these terminal assemblies. This is especially true for the terminal assemblies on compressors which are shipped by sea. On some trans-oceanic voyages, the compressors are shipped in open crates positioned on the open decks of the cargo vessel. In this shipping position, the compressors and thus the terminal assemblies are subjected to the high humidity of the sea air as well as periodic spraying of salt water on the compressors due to the wave action of the cargo vessel as it proceeds across the ocean.

Typically, a prior art hermetic terminal assembly consists of an electrical terminal and a corresponding electrical cable. The electrical terminal is installed in a hole formed in the hermetic shell of a hermetic compressor so that current may be carried to the motor of the compressor from an external source of power through the corresponding cable where the cable is attached to the electrical terminal. The prior art electric terminals comprise a body welded or secured to the shell of the compressor and a plurality of conductor pins extending through the body. In order to seal and electrically insulate the conductor pins relative to the body, a glass to metal seal is employed, having an epoxy and/or silicone rubber overcoating. A fence normally extends from the hermetic shell and can be integral with the body or it can be a separate component secured to the shell. The fence is designed to protect the electrical terminal and to interface with the corresponding cable to seal the electrical connection between the cable and the electrical terminal from the effects of the external environment.

While these prior art terminal assemblies have been effective in sealing the electrical connection between the cable and the terminal during normal operation of the compressor, a more effective sealing configuration is required for the compressors which are subjected to the open deck shipping environment described above.

SUMMARY OF THE INVENTION

The present invention provides the art with a terminal assembly which is capable of protecting the electrical connection between the electrical terminal and the corresponding cable when the compressor is exposed to the environment normally experienced during open deck trans-oceanic shipping. The present invention includes an electrical terminal block which includes a plurality of conductor pins. The terminal block is welded or otherwise secured to a shell of the compressor. A terminal fence is secured to the exterior of the shell in surrounding relationship to the terminal block. An intermediate gasket is placed over the terminal block to provide a seal at the interface with the shell, a seal around the external surface of the terminal block as well as a seal around each individual conductor pin. A power cable is assembled into the terminal bock which makes the necessary electrical connections with the conductor pins and also sealingly engages the power cable with both the intermediate gasket and the terminal fence. Finally, a terminal box cover is placed in sealing relation to the shell and is fixedly secured to the terminal fence. The terminal box cover, the power cable, the terminal fence and the intermediate gasket all cooperate to form a plurality of seals which effectively protect the electrical connections from marine environments.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
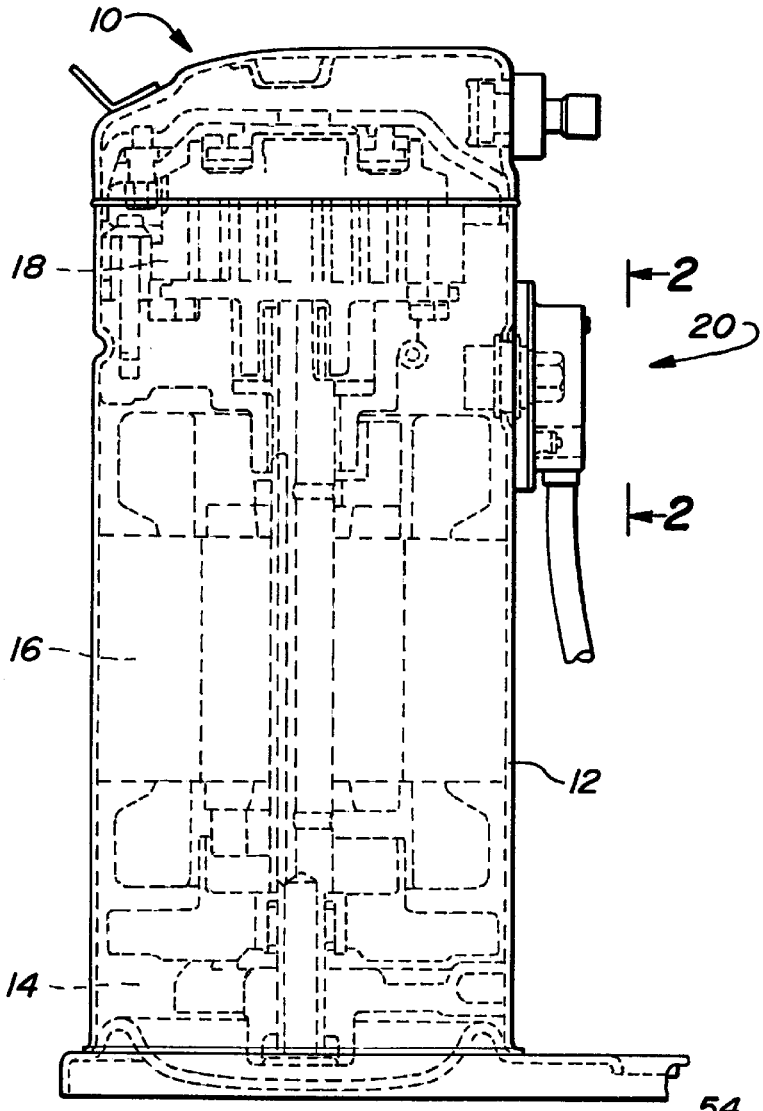
FIG. 1 is a side elevational view, partially in cross-section, of a hermetic motor compressor incorporating the sealed terminal assembly according to the present invention.

Referring now to the drawings in which like reference numerals designate like or corresponding parts throughout the several views, there is shown in FIG. 1, a hermetic compressor assembly which is designated generally by the reference numeral 10. Compressor assembly 10 can be a scroll compressor, a piston compressor or any other type of compressor. Compressor assembly 10 comprises a hermetic shell 12 which defines a sealed chamber 14 within which a motor 16 and a compressor 18 are disposed. A terminal assembly 20 is sealingly associated with compressor assembly 10 and provides for the electrical connection between an external source of power (not shown) and motor 16 disposed within sealed chamber 14.

Figure 2:
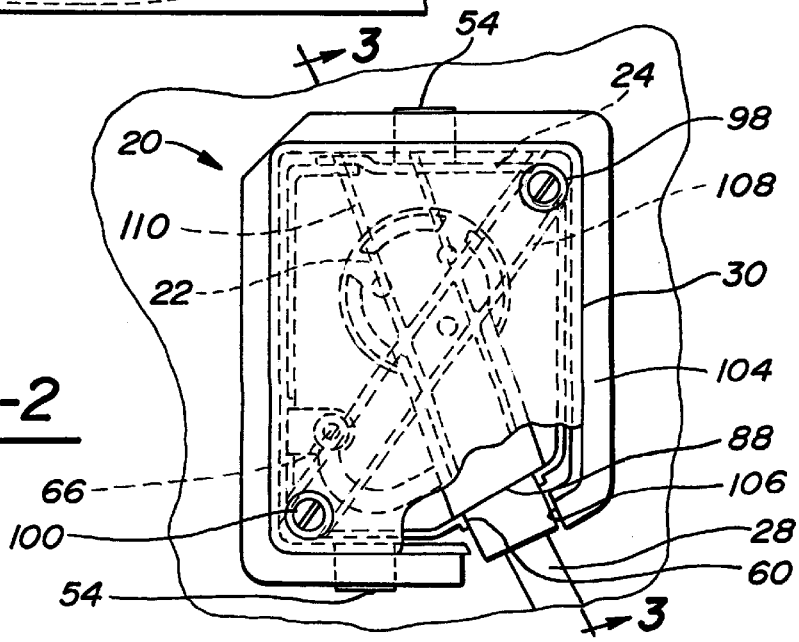
FIG. 2 is an enlarged side elevational view of the sealed terminal assembly shown in FIG. 1.
Figure 3:
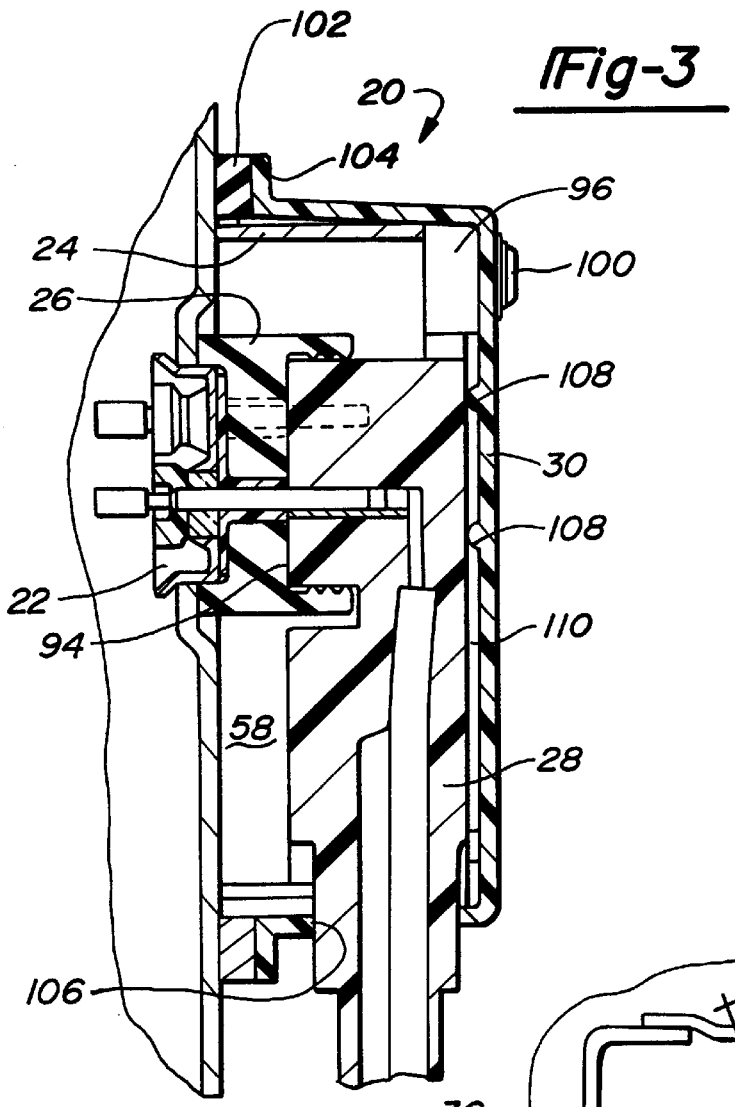
FIG. 3 is a cross-sectional view of the sealed terminal assembly of the present invention taken in the general direction of line 3—3 shown in FIG. 2.

Referring now to FIGS. 2 and 3, terminal assembly 20 comprises a terminal block 22, a terminal fence 24, an intermediate gasket 26, a power cable 28 and a terminal box cover 30.

Figure 4:
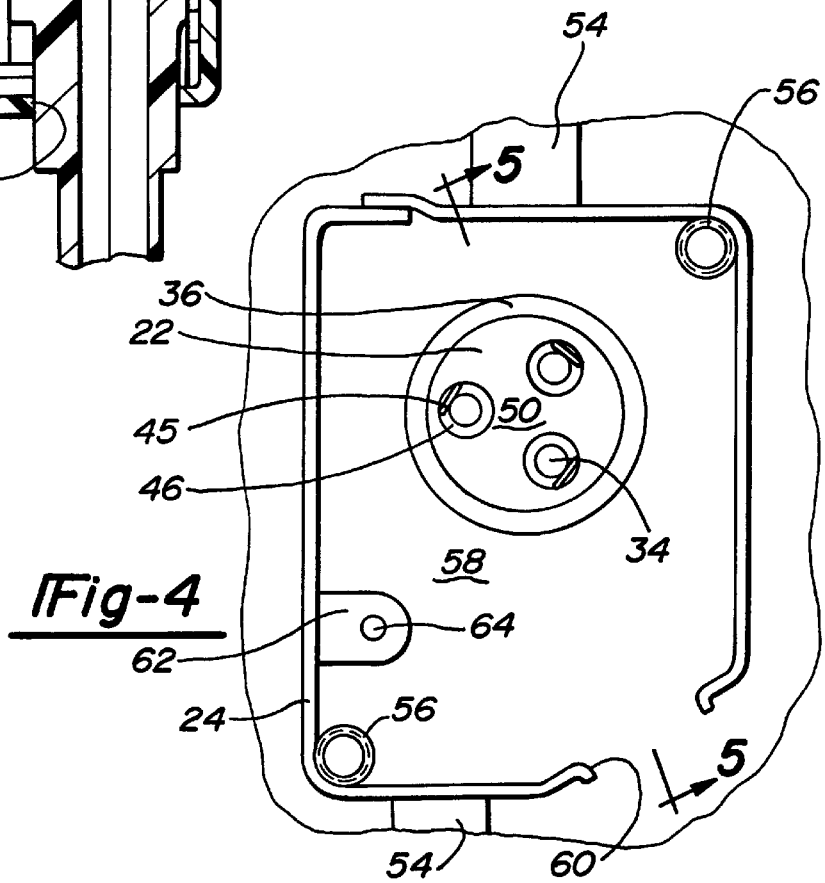
FIG. 4 is a side elevational view of the terminal block and terminal fence of the present invention.
Figure 5:
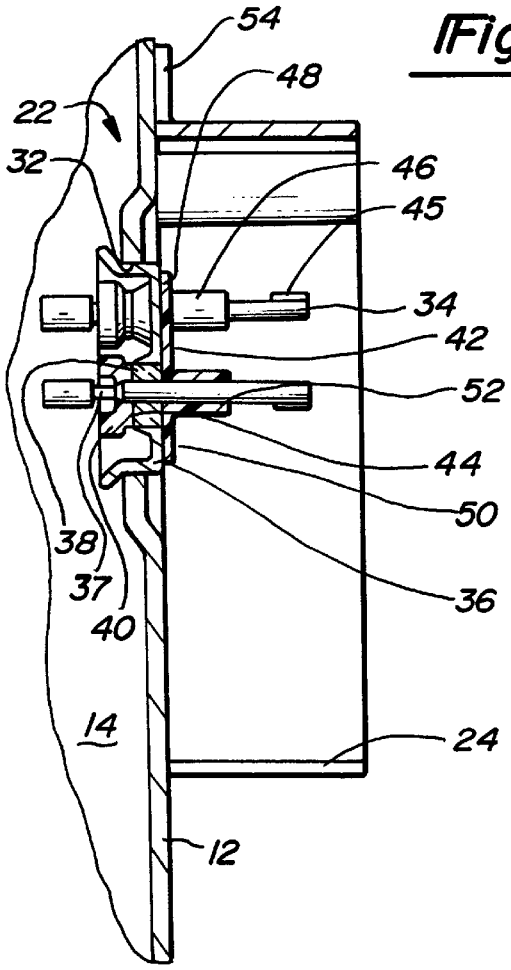
FIG. 5 is a cross-sectional view of the terminal block and terminal fence of the present invention taken in the general direction of line 5—5 shown in FIG. 4.

Referring now to FIGS. 4 and 5, terminal block 22 is sealingly disposed within an aperture 32 which extends through a flattened portion of shell 12. The sealing relationship between terminal block 22 and shell 12 maintains the integrity of sealed chamber 14 and provides for the electrical connection through shell 12. Terminal block 22 is shown comprising a plurality of conductor pins 34, a terminal block body 36, a plurality of fused glass insulators 38, a plurality of ceramic insulators 40 and a silicone rubber molding 42. Terminal block body 36 is a cup shaped metal member defining a plurality of holes 44. Terminal block body 36 is sealingly disposed within aperture 32 by resistance welding or other methods known well in the art.

Each of the plurality of holes 44 is adapted for receiving a respective fused glass insulator 38 which is sealingly fused to both terminal block body 36 and a respective conductor pin 34. Each conductor pin 34 extends through a respective fused glass insulator 38 to provide for the electrical communication between the exterior and interior of shell 12. Each conductor pin 34 includes a reduced diameter section 37 which acts as a fuse-like link in the event of an internal short circuit.

Each conductor pin 34 has a respective ceramic insulator 40 secured to the end of pin 34 extending into chamber 14 and a flat male connector 45 fixedly secured by brazing or other means known well in the art to the end of pin 34 extending out of chamber 14. Ceramic insulators 40 insulate conductor pins 34 and their associated connection to motor 16 from contact with terminal block body 36 as well as providing insulation between adjacent pins 34. Silicone rubber molding 42 is located on the outside of shell 12 and includes a plurality of upstanding jackets 46 which extend from a base 48 having an external sealing surface 50. The plurality of upstanding jackets 46 are equal to and arranged in the same pattern as the plurality of conductor pins 34. Each of jackets 46 defines an aperture 52 extending through molding 42 and adapted to receive a respective conductor pin 34. The relationship between apertures 52 and conductor pins 34 serves to both seal and provide an over-surface insulation protection for conductor pins 34.

Figure 8:
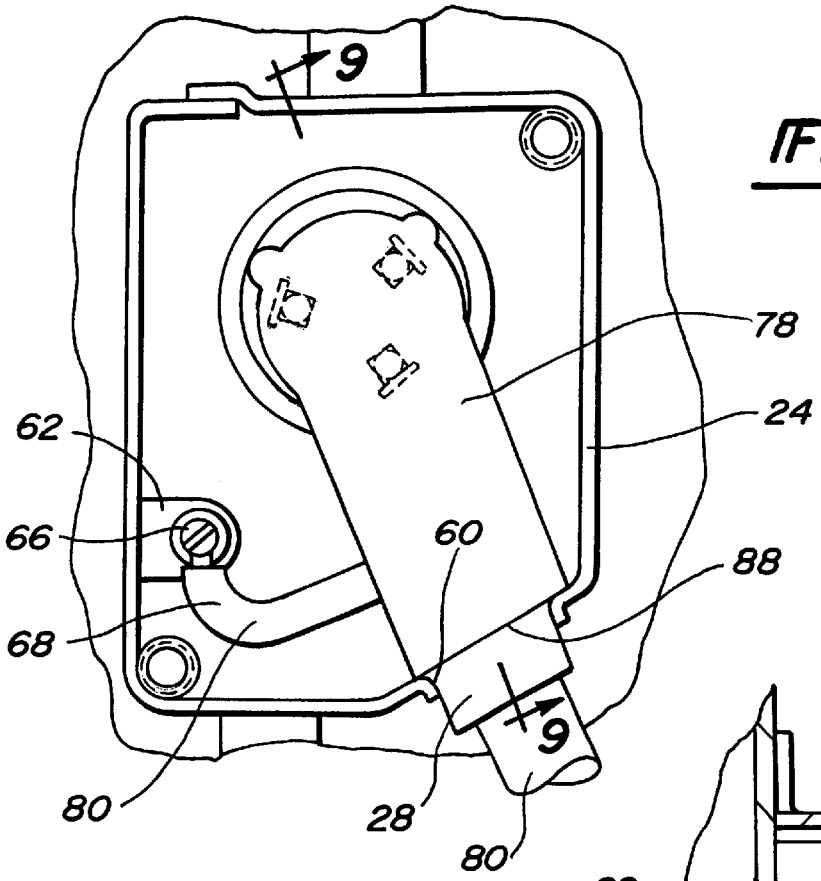
FIG. 8 is a view similar to FIG. 6 with the addition of the power cable in accordance with the present invention.
Figure 9:
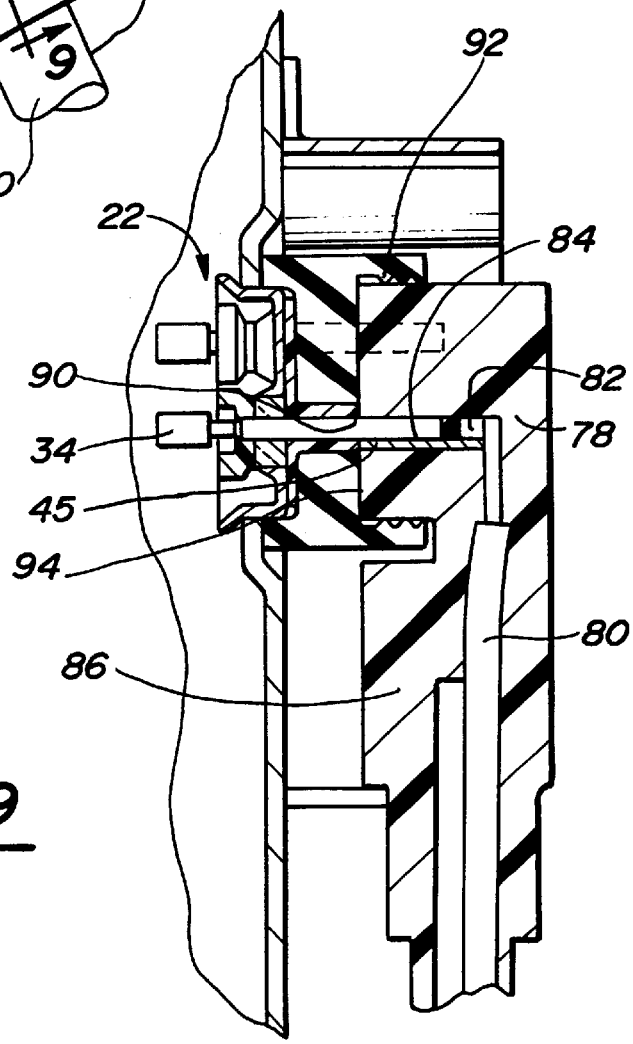
FIG. 9 is a cross-sectional view similar to FIG. 7 but taken in the general direction of line 9—9 shown in FIG. 8.

Terminal fence 24 is fixedly secured to the outside of shell 12 by resistance welding or other means known well in the art. A pair of tabs 54 extend from the upper and lower wall of fence 24 to facilitate the resistance welding of terminal fence 24 to shell 12. Terminal fence 24 is generally rectangular in shape and includes a pair of internally threaded tubes 56. Tubes 56 are fixedly secured to terminal fence 24 at opposing corners of terminal fence 24 by brazing or other means known well in the art. The threaded bores of tubes 56 are utilized for securing terminal box cover 30 to terminal fence 24 as will be described later herein. Terminal fence 24 defines a cavity 58 within which terminal block 22 is disposed. Terminal fence 24 also defines an opening 60 which is adapted for sealingly receiving power cable 28 as is shown in FIGS. 8 and 9. A portion of the wall of terminal fence 24 is cut out and bent generally perpendicular to the wall as shown in FIGS. 4 and 5 to form a grounding lug 62. Grounding lug 62 defines an aperture 64 which is adapted to receive a self tapping screw 66 which holds a grounding lead 68 extending from power cable 28. Terminal fence 24 protects conductor pins 34 from inadvertent damage due to the handling of compressor assembly 10 by the manufacturer of the compressor, the manufacturer of the apparatus utilizing compressor assembly 10 and any service personnel involved with servicing compressor 10.

Figure 7:
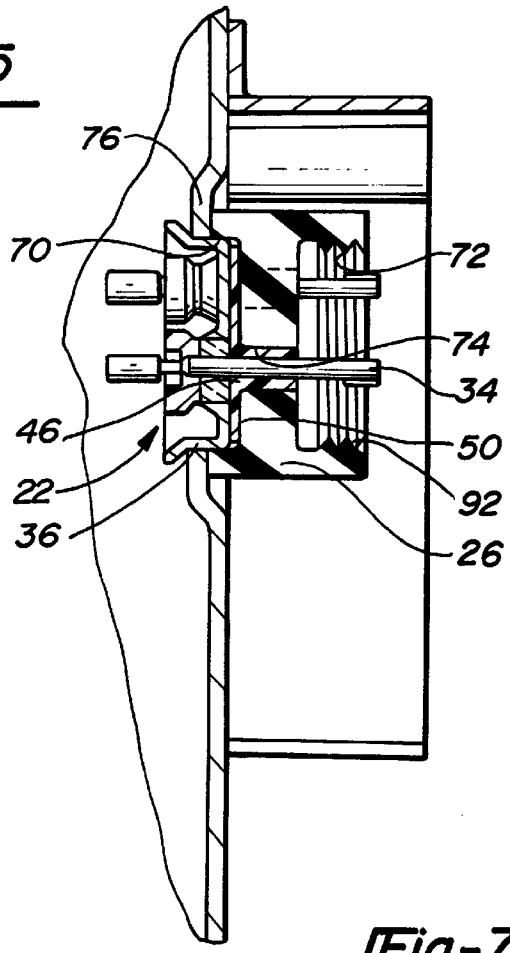
FIG. 7 is a cross-sectional view similar to FIG. 5 but taken the general direction of line 7—7 shown in FIG. 6.
Figure 6:
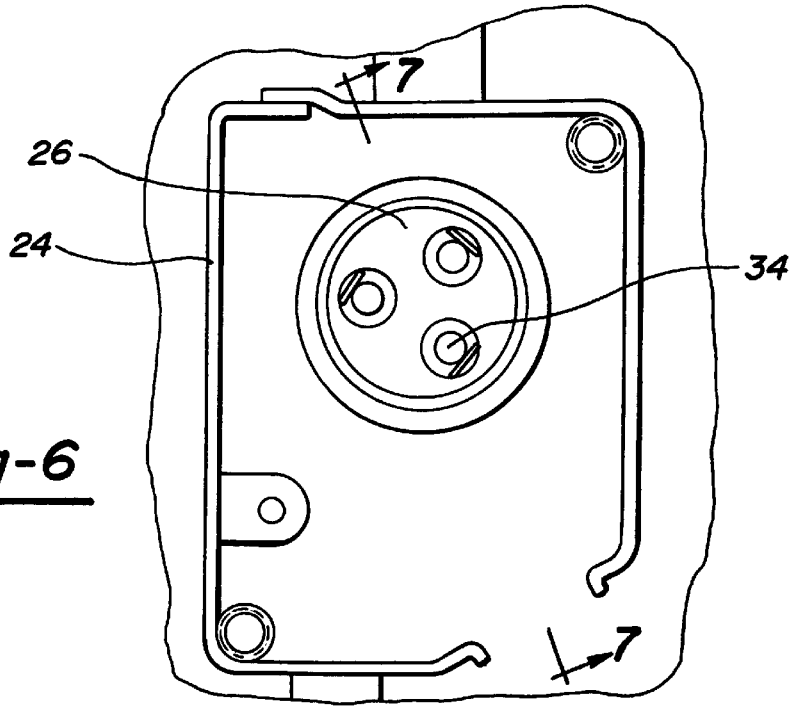
FIG. 6 is a view similar to FIG. 4 with the addition of the intermediate gasket in accordance with the present invention.

Referring now to FIGS. 6 and 7, intermediate gasket 26 is a generally cylindrical gasket preferably manufactured from Dow Corning 3120 RTV rubber or General Electric RTV 31 rubber. Gasket 26 defines a first cylindrical cavity 70 which is designed to mate with terminal block 22, a second cylindrical cavity 72 which is designed to mate with power cable 28 and a plurality of apertures 74 extending between cavities 70 and 72. The plurality of apertures 74 are equal to and are arranged in the same pattern as the plurality of conductor pins 34 in order to allow pins 34 to extend through gasket 26. The inside diameter of each aperture 74 is designed to sealing engage a respective jacket 46 of silicone rubber molding 42. Gasket 26 is positioned over terminal block 22 such that pins 34 extend through apertures 74 to mate with power cable 28. The portion of terminal block body 36 which extends outside of shell 12 is disposed within cavity 70. The internal surface of cavity 70 is designed to sealingly engage the outside diameter of terminal block body 36 as well as the external sealing surface 50 of molding 42. In addition, an external face 76 of gasket 26 is designed to sealingly engage the flattened portion of shell 12.

Referring now to FIGS. 8 and 9, power cable 28 includes a molded plug 78 and a plurality of wires 80 which extend between plug 78 and the external supply of electrical power. Each of three wires 80 is electrically connected and secured to a connector 82 which provides a female electrical receptacle 84 for receiving a respective male connector 45. Connectors 45 and receptacles 84 are well known in the art and will not be discussed in detail here. The fourth wire 80 forms grounding lead 68 which is secured to grounding lug 62 as detailed above. The plurality of wires extend through a radially extending jacket 86 which provides the access for three of the plurality of wires 80 into plug 78 in an orderly manner and for the fourth wire 80 to extend out of jacket 86 to form grounding lead 68. Preferably, plug 78 and jacket 86 are integrally formed from silicone rubber. Jacket 86 includes an angular surface 88 which sealingly engages opening 60 in terminal fence 24. The plurality of receptacles 84 are equal in number to and are arranged in the identical pattern to conductor pins 34 of terminal block 22. A plurality of apertures 90 extend from the plurality of receptacles 84 through plug 78 to allow access to receptacles 84 by conductor pins 34 and male connectors 45. The orientation of the plurality of conductor pins 34, the positioning of opening 60 and the angulation of surface 88 cooperate to insure that when male connectors 45 are in registry with and engaged by female receptacles 84, jacket 86 and angular surface 88 are in alignment with opening 60 in terminal fence 24 to provide the necessary sealing relationship.

Once power cable 28 is assembled to terminal block 22 by mating connectors 45 with receptacles 84, molded plug 78 is disposed within cavity 72 of intermediate gasket 26. The internal wall of cavity 72 defines a plurality of sealing ribs 92 which sealingly engage the outside of molded plug 78. In addition, an external face 94 of molded plug 78 sealingly engages the internal surface of cavity 72 to provide an additional face seal for terminal assembly 20. The connection between connectors 45 and receptacles 84 provides for electrical connection between the two components and helps to retain power cable 28 in place during the remainder of assembly of terminal assembly 20.

Referring back to FIGS. 2 and 3, terminal box cover 30 is a rectangular box shaped component defining an internal cavity 96 within which the components of terminal assembly 20 are disposed. The top of cover 30 defines a pair of holes 98 which align with the pair of threaded tubes 56 of terminal fence 24. A bolt 100 extends through each hole 98 and is threadingly received within a respective tube 56 to fixedly secure cover 30 to compressor assembly 10. A seal 102, preferably made from EPDM sponge rubber is disposed between shell 12 and a flange 104 formed around the open end of cover 30. The lower wall of cover 30 defines an aperture 106 which allows power cable 28 to extend through cover 30. The internal surface of the top of cover 30 defines a first pair of parallel ribs 108 which extend between the pair of holes 98 to provide rigidity for the top of cover 30. The internal surface of the tip of cover 30 defines a second pair of ribs 110 which extend generally parallel to power cable 28 such that tightening of bolts 100 causes engagement of ribs 110 with power cable 28 to hold power cable 28 in place and provide a slight compressive load between intermediate gasket 26 and shell 12 and terminal block 22 as well as between intermediate gasket 26 and power cable 28. Thus, the assembly of cover 30 to terminal fence 24 completes the assembly of terminal assembly 20 and provides six distinct areas of sealing for terminal assembly 20. The first seal is provided between external face 76 of intermediate gasket 26 and the flattened portion of shell 12 (FIG. 7). The second seal is provided between the external surface of terminal block body 36 of terminal assembly 20 and the internal surface of cavity 70 of intermediate gasket 26 (FIG. 7). The third seal is between external surface 50 of molding 42 and the internal surface of cavity 70 (FIG. 7). The fourth seal is between the internal surface of apertures 74 and the external surface of jackets 46 (FIG. 7). The fifth seal is between external face 94 of molded plug 78 and the internal surface of cavity 72 of intermediate gasket 26 (FIG. 9). The sixth and final seal is between the external surface of molded plug 78 and sealing ribs 92 in cavity 72 of intermediate gasket 26 (FIG. 9).

While the above detailed description describes the preferred embodiment of the present invention, it should be understood that the present invention is susceptible to modification, variation and alteration without deviating from the scope and fair meaning of the subjoined claims.

What is claimed is:

1. A terminal assembly for a compressor having a shell, said terminal assembly comprising:

a terminal block adapted to be secured to said shell;

a terminal fence adapted to be secured to said shell and defining a cavity, said terminal block being disposed within said cavity;

a power cable at least partially disposed within said cavity and having a molded plug and at least one electrical receptacle, said electrical receptacle being in electrical communication with said terminal block, said power cable sealingly engaging said fence to seal said cavity;

an intermediate gasket disposed between said molded plug and said terminal block, said intermediate gasket sealingly engaging said molded plug and said terminal block; and a terminal block cover secured to said terminal fence for closing and sealing said cavity, said terminal block cover engaging said molded plug to bias said molded plug towards said intermediate gasket, to bias said intermediate gasket towards said terminal block and to bias said at least one electrical receptacle into said electrical contact with said terminal block.

2. The terminal assembly according to claim 1 wherein, said terminal fence includes a grounding lug.

3. The terminal assembly according to claim 1 wherein, said intermediate gasket is adapted to sealingly engage said shell.

4. The terminal assembly according to claim 1 wherein, said intermediate gasket sealingly engages said terminal block in two separate locations.

5. The terminal assembly according to claim 1 wherein, said terminal block comprises a terminal block body, a plurality of conductor pins extending through said body and a molding covering a portion of said conductor pins, said intermediate gasket sealingly engaging said molding.

6. The terminal assembly according to claim 1 wherein, said intermediate gasket includes a plurality of sealing ribs sealingly engaging said power cable.

7. The terminal assembly according to claim 1 wherein, said terminal block includes at least one conductor pin, said electrical receptacle of said power cable being in electrical communication with said conductor pin of said terminal block.

8. The terminal assembly according to claim 1 wherein, said terminal block cover is adapted to sealingly engage said shell.

9. The terminal assembly according to claim 1 wherein, the engagement between said cover and said power cable enhances the sealing engagement between said intermediate gasket and said power cable.

10. The terminal assembly according to claim 1 wherein, the engagement between said cover and said power cable enhances the sealing engagement between said intermediate gasket and said terminal block.

11. A terminal assembly for a compressor having a shell, said terminal assembly comprising:

a terminal block adapted to be secured to said shell, said terminal block including a terminal block body and at least one conductor pin extending through said terminal block body;

a terminal fence adapted to be secured to said shell and defining a cavity, said terminal block being disposed within said cavity;

a power cable at least partially disposed within said cavity and having a molded plug and at least one electrical receptacle, said electrical receptacle being in electrical communication with said conductor pin, said power cable sealingly engaging said fence to seal said cavity;

an intermediate gasket disposed between said molded plug and said terminal block, said intermediate gasket sealingly engaging said molded plug and said terminal block, said intermediate gasket being adapted to sealingly engage said shell; and a terminal block cover secured to said terminal fence for closing and sealing said cavity, said terminal block cover engaging said molded plug to bias said molded plug towards said intermediate gasket, to bias said intermediate gasket towards said terminal block and to bias said at least one electrical receptacle into said electrical contact with said terminal block.

12. The terminal assembly according to claim 11 wherein, said terminal fence includes a grounding lug.

13. The terminal assembly according to claim 11 wherein, said intermediate gasket sealingly engages said terminal block in two separate locations.

14. The terminal assembly according to claim 11 wherein, said terminal block further includes a molding covering a portion of said conductor pins, said intermediate gasket sealingly engaging said molding.

15. The terminal assembly according to claim 11 wherein, said intermediate gasket includes a plurality of sealing ribs sealingly engaging said power cable.

16. The terminal assembly according to claim 11 wherein, said terminal block cover is adapted to sealingly engage said shell.

17. The terminal assembly according to claim 11 wherein, the engagement between said cover and said power cable enhances the sealing engagement between said intermediate gasket and said power cable.

18. The terminal assembly according to claim 11 wherein, the engagement between said cover and said power cable enhances the sealing engagement between said intermediate gasket and said terminal block.

* * * * *

UNITED STATES PATENT AND TRADEMARK OFFICE

CERTIFICATE OF CORRECTION

PATENT NO. : 6,372,993 B1
DATED : April 16, 2002
INVENTOR(S) : Richard Edgar Eckels and Carl Herman Knapke It is certified that error appears in the above-identified patent and that said Letters Patent is hereby corrected as shown below:

Column 1,
Line 4, after “This” insert -- is --.

Column 2,
Line 14, “bock” should be -- block --.
Line 52, after “taken” insert -- in --.

Column 4,
Line 31, “sealing” should be -- sealingly --.

Signed and Sealed this

Twenty-second Day of April, 2003

JAMES E. ROGAN
*Director of the United States Patent and Trademark Office*